US008328696B2

(12) United States Patent
Dieter

(10) Patent No.: US 8,328,696 B2
(45) **Date of Patent: *Dec. 11, 2012**

(54) COLLAPSIBLE ATHLETIC TRAINING LADDER

(75) Inventor: William Dieter, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/311,331

(22) Filed: Dec. 5, 2011

(65) Prior Publication Data

US 2012/0077644 A1 Mar. 29, 2012

Related U.S. Application Data

(63) Continuation of application No. 12/986,148, filed on Jan. 6, 2011, now Pat. No. 8,070,656, which is a continuation of application No. 11/714,716, filed on Mar. 5, 2007, now Pat. No. 7,874,959.

(60) Provisional application No. 60/779,397, filed on Mar. 3, 2006.

(51) Int. Cl.

| | |
|---|---|
| ***A63B 22/00*** | (2006.01) |
| ***A63B 67/00*** | (2006.01) |
| ***A63B 69/00*** | (2006.01) |
| ***A63B 71/00*** | (2006.01) |
| ***A63K 3/00*** | (2006.01) |

(52) U.S. Cl. ..... 482/51; 482/14; 473/414; 473/440

(58) Field of Classification Search ..... 482/14–17, 482/23, 34–35, 38–41, 51–52, 74, 79, 81, 482/131, 148; 182/152, 156, 164, 196, 228.1; 473/414–415, 438, 440; 273/440–441, 444; D21/662, 672, 685–686, 691, 698, 706, 788; *A63K 3/00; A63B 22/00, 67/00, 69/00, 71/00*

See application file for complete search history.

(56) References Cited

U.S. PATENT DOCUMENTS

| | | | | |
|---|---|---|---|---|
| 2,017,536 A | | 10/1935 | Hase | |
| 2,286,936 A | | 6/1942 | Willis | |
| 2,397,953 A | * | 4/1946 | Ellis | 182/196 |
| 2,834,529 A | * | 5/1958 | Dahlander, Sr | 182/198 |
| 2,891,793 A | | 6/1959 | Mudry | |

(Continued)

FOREIGN PATENT DOCUMENTS

GB 2411845 A 9/2005

OTHER PUBLICATIONS

International Search Report; PCT Appln. No. PCT/US2007/05607; Oct. 16, 2007; 2 pages.

(Continued)

*Primary Examiner* — Oren Ginsberg
(74) *Attorney, Agent, or Firm* — Banner & Witcoff, Ltd.

(57) ABSTRACT

A collapsible ladder for use primarily for athletic training and the like has a plurality of spaced-apart, substantially rigid rungs secured with collapsible connectors to a plurality of spaced-apart, substantially rigid spacers extending therebetween. In one disclosed embodiment, the collapsible connectors are strips of flexible material extending between the rungs and spacers. Another disclosed embodiment has a second set of rungs aligned substantially parallel to the plurality of spaced-apart rungs along a common central set of spacers. The collapsible connectors allow the ladder to be quickly and easily transitioned between an extended, operational position, and a collapsed, storage position.

20 Claims, 4 Drawing Sheets

U.S. PATENT DOCUMENTS

| | | | | | |
|---|---|---|---|---|---|
| 3,078,954 | A | * | 2/1963 | MaCleod | 182/196 |
| 3,226,118 | A | | 12/1965 | Nehl | |
| 3,255,115 | A | | 6/1966 | Peterson | |
| 3,653,463 | A | | 4/1972 | Neal et al. | |
| 3,768,809 | A | | 10/1973 | Ciarfello | |
| 4,078,793 | A | | 3/1978 | Allen | |
| 4,176,471 | A | | 12/1979 | Roe | |
| 4,185,819 | A | | 1/1980 | Hartley | |
| 4,630,819 | A | | 12/1986 | Levin | |
| 4,867,275 | A | | 9/1989 | Islava et al. | |
| 5,018,600 | A | | 5/1991 | Sobczak | |
| 5,203,427 | A | | 4/1993 | Williams et al. | |
| 5,499,692 | A | * | 3/1996 | Brook | 182/196 |
| 5,746,287 | A | | 5/1998 | Durham | |
| 5,971,105 | A | | 10/1999 | Jacobson | |
| 6,475,117 | B1 | | 11/2002 | Berglund et al. | |
| 6,530,455 | B1 | | 3/2003 | Arnette et al. | |
| 6,955,631 | B2 | | 10/2005 | Chen Wu | |
| 7,874,959 | B2 | * | 1/2011 | Dieter | 482/51 |
| 8,070,656 | B2 | * | 12/2011 | Dieter | 482/51 |
| 2002/0098947 | A1 | | 7/2002 | Brown | |
| 2003/0022760 | A1 | | 1/2003 | Chen Wu | |
| 2003/0104910 | A1 | | 6/2003 | McCoy | |
| 2004/0094363 | A1 | * | 5/2004 | Bagshaw | 182/196 |

OTHER PUBLICATIONS

Written Opinion of the International Searching Authority; PCT Appln. No. PCT/US2007/05607; Oct. 16, 2007; 4 pages.

Notification of Transmittal of the International Search Report; PCT Appln. No. PCT/US2007/05607; Oct. 16, 2007; 1 pages.

* cited by examiner

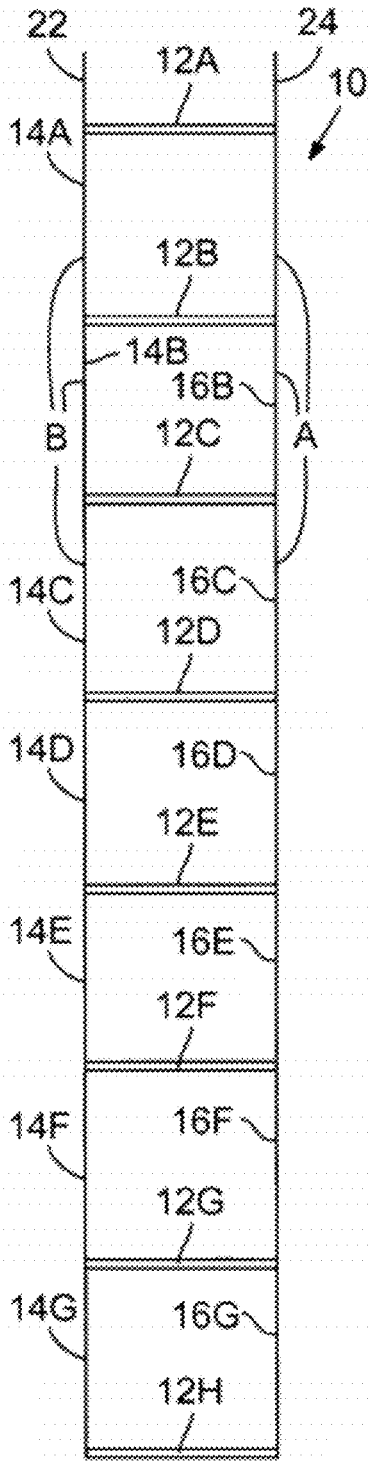
FIG. 5A
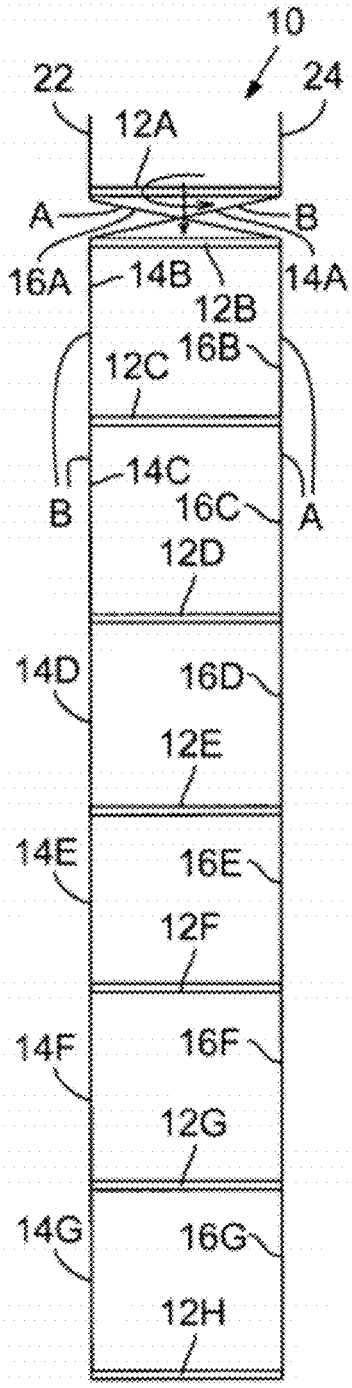
FIG. 5B
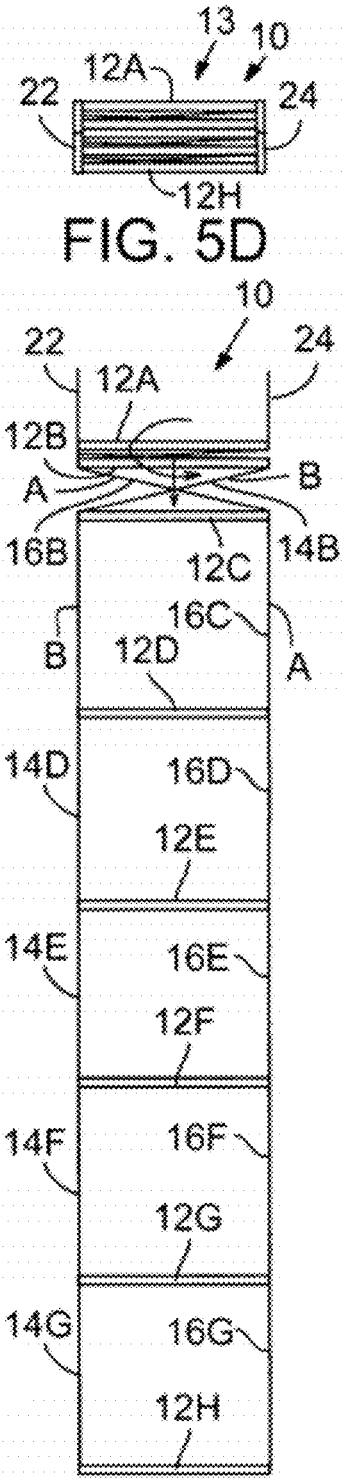
FIG. 5D
FIG. 5C

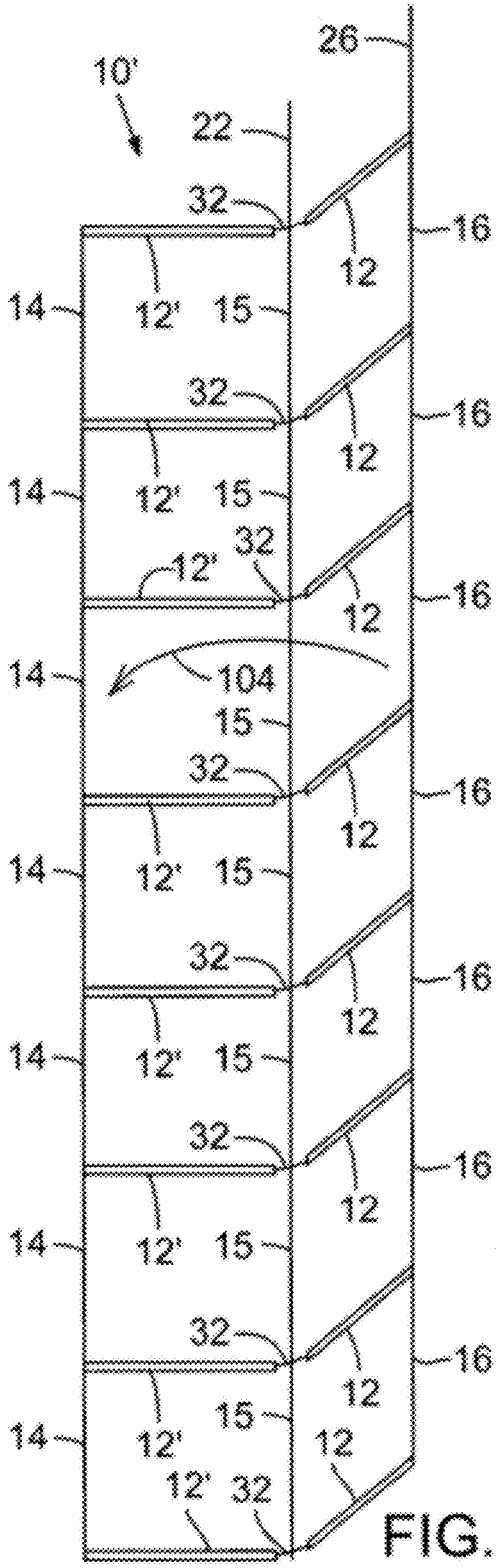
FIG. 6A
FIG. 6B
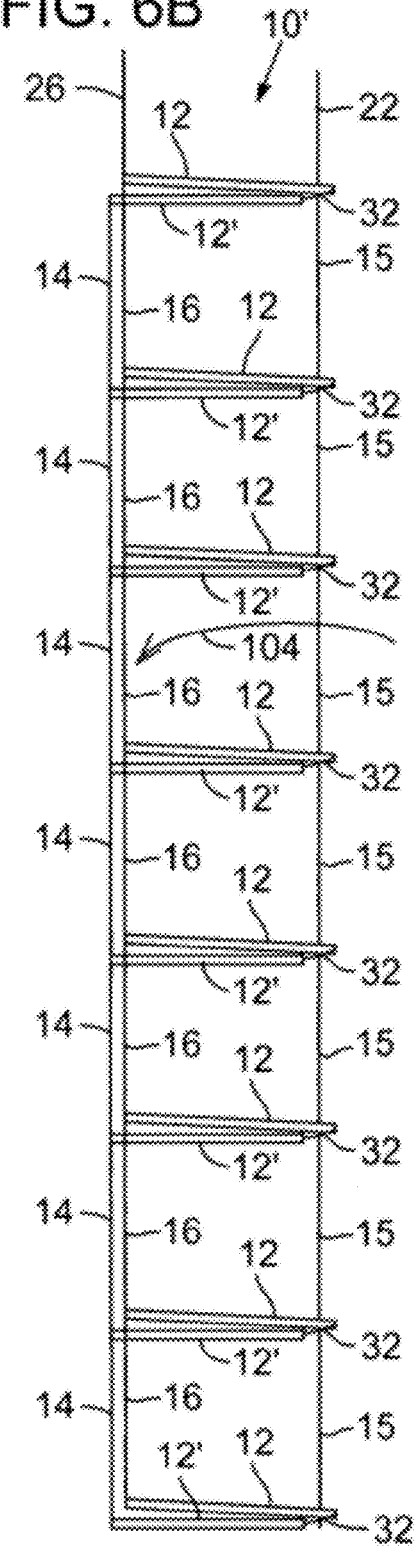

COLLAPSIBLE ATHLETIC TRAINING LADDER

CROSS REFERENCE TO RELATED APPLICATION

This application is a continuation of U.S. non-provisional patent application Ser. No. 12/986,148 filed Jan. 6, 2011, which is a continuation of U.S. non-provisional patent application Ser. No. 11/714,716, filed on Mar. 5, 2007 which application claims priority to U.S. provisional patent application Ser. No. 60/779,397, filed on Mar. 3, 2006. All of which are entirely incorporated herein by reference and made a part of the record.

FIELD OF THE INVENTION

The present invention relates to a training ladder used primarily for athletic events, athletic training, and the like.

BACKGROUND OF THE INVENTION

Training ladders are elongate spaced apart rungs that are positioned on the ground and substantially parallel to each other. A typical training exercise using the ladder involves the athlete attempting to quickly run between the rungs without touching them with his or her feet.

Typical training ladders include a plurality of substantially rigid, elongate, rungs that are spaced apart from each other by a webbing of flexible material such as rope, nylon strips or the like. During use of these known training ladders, the rungs tend to become displaced as the athlete inadvertently contacts them or the webbing holding them apart. Accordingly, these known ladders are typically staked to the ground in an effort to keep them in place during use. These stakes tend to become lost during use and storage of the ladder.

Moreover, such staking limits the ease of use of the ladder. For example, if an athlete inadvertently positions his or her foot under the webbing while performing an exercise drill and then lifts their foot without first removing it from under the webbing, he or she can easily trip, particularly when the webbing is staked to the ground.

In addition, the webbing tends to become tangled when the ladder is collapsed and stored, thereby compromising the user's ability to easily set-up the ladder for future use.

SUMMARY OF THE INVENTION

Despite the known athletic training ladder structures, there remains a need for a training ladder that is economical to manufacture and purchase, and is easy to set-up, use, collapse, and store without necessarily requiring the user to stake the ladder to the ground during use. In addition to the other benefits disclosed herein, the present invention fulfills these needs.

The ladder preferably has a plurality of spaced-apart, substantially rigid rungs secured with collapsible connectors to a plurality of spaced-apart, substantially rigid spacers extending therebetween. In one disclosed embodiment, the collapsible connectors are strips of flexible material extending between the rungs and spacers. Another disclosed embodiment has a second set of rungs aligned substantially parallel to the plurality of spaced-apart rungs along a common central set of spacers.

The collapsible connectors in combination with the substantially rigid spacers allow the ladder to be quickly and easily transitioned between an extended, operational position, and a collapsed, storage position without requiring stakes to secure the ladder to the ground.

BRIEF DESCRIPTION OF THE DRAWINGS

FIGS. 5A-D are schematic diagrams of the collapsible athletic ladder of FIG. 1 showing a possible series of steps associated with collapsing the ladder from its fully extended configuration (shown in FIG. 5A) to its fully stored position (shown in FIG. 5D).

FIGS. 6A & 6B are schematic diagrams of the alternative collapsible athletic ladder of FIG. 2 showing a possible series of additional steps associated with collapsing the ladder from its fully extended position to its fully stored position.

DETAILED DESCRIPTION OF PREFERRED EMBODIMENTS

A collapsible athletic training ladder 10, 10' having substantially rigid spacers 14, 15, 16 that are collapsibly secured to a plurality of parallel aligned, spaced-apart rungs 12, 12' with collapsible connectors 19 is disclosed in FIGS. 1-8. A first preferred embodiment of the ladder 10 is shown in FIGS. 1, 3, and 5A-D, and a second preferred embodiment of the ladder 10' is shown in FIGS. 2, 4, and 6A & 6B. In order to reduce undue repetition, like elements between these embodiments are like numbered.

Figures 1, 2:
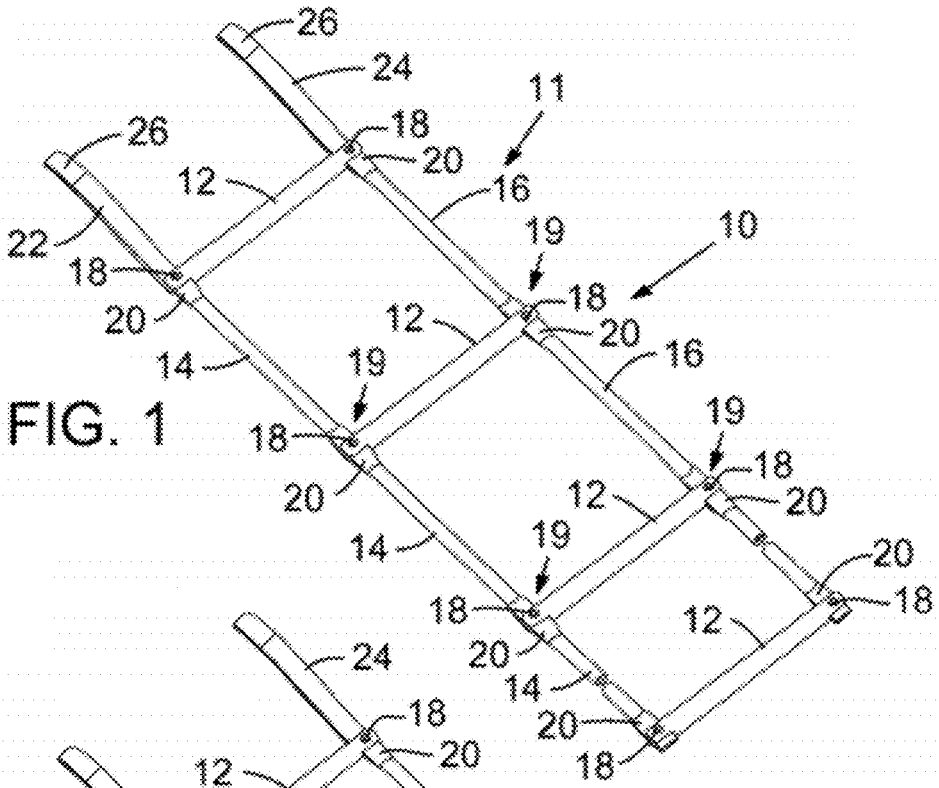
FIG. 1 is a top, isometric view of a collapsible athletic ladder in conformance with an embodiment of the present invention.
FIG. 2 is a top, isometric view of an alternative collapsible athletic ladder in conformance with an embodiment of the present invention.

Referring to FIGS. 1, 3, and 5A-D, the collapsible ladder 10 includes a plurality of parrellely-aligned and spaced apart rungs 12 that each have a first end and an opposite second end. As best shown in FIG. 1, each first end of each rung 12 is operably secured to a right rigid spacer 16 through a collapsible connector 19. Similarly, each second end of each rung is operably secured to a left rigid spacer 14 through a collapsible connector 19. The distal ends of each spacer 14, 16 are operably secured to the distal ends of each rung 12 through collapsible connector 19 as shown so that the ladder remains substantially planar and the rungs 12 remain aligned substantially parallel to each when the ladder 10 is in its extended position 11 resting on a substantially planar surface as shown in FIG. 1.

Preferably, the substantially rigid rungs 12 are formed of a light weight and durable material such as an ABS polymer or the like.

Figure 3:
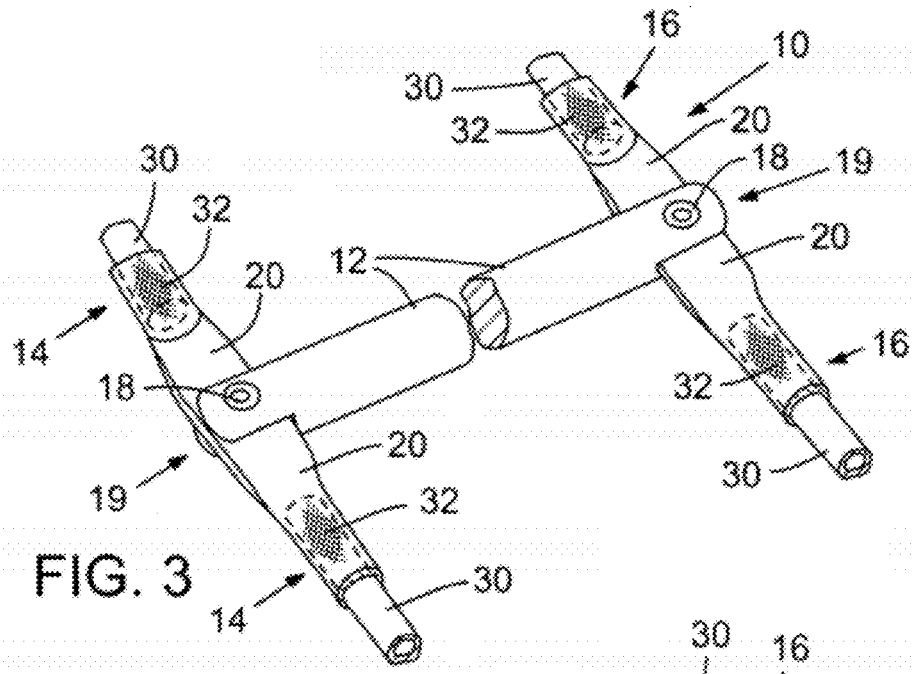
FIG. 3 is an enlarged, partial view of a section of the collapsible athletic ladder of FIG. 1.

As best shown in FIG. 3, the elongate spacers 14, 16, preferably have a substantially rigid member 30, preferably formed with a light weight and durable material such as an ABS polymer or the like. The substantially rigid member 30 is preferably received within a pocket 32 of an elongate flexible structure, such as woven nylon or the like. Preferably, the rigid member 30 is rigidly secured within the pocket 32 by adhesive, sewing the pocket shut, or the like. A plurality of rigid members 30 are aligned within their respective pockets 32, but spaced apart from each other to define a flexible mounting portion 20 therebetween.

The distal ends of the rungs 12 are operably secured to the flexible mounting portion 20. Preferably, the rungs are rigidly secured to the flexible mounting portion 20 with a rivet 18 that extends through both the rung 12 and the flexible mounting portion 20. Alternatively, the rung 12 may be pivotally secured to the flexible mounting portion 20.

Preferably, the rungs 12 are elongate shafts defining a first outer diameter and the rigid members 30 are elongate shafts defining a second outer diameter with the first outer diameter being larger than the second outer diameter. More preferably, the rungs 12 and spacers 14, 16 have different colors from each other, thereby helping an athlete distinguish between the two during use.

Referring to FIGS. 5A-D, it can be appreciated that the collapsible connectors 19 connecting the rungs 12A-12H with the spacers 14A-G and 16A-G allow the ladder 10 to easily transition from its extended position 11 (FIG. 1) to its fully collapsed position 13 shown in FIG. 5D. This is preferably accomplished by performing the following steps:

With the ladder in its extended position shown in FIG. 5A, a user grasps the first rung 12*a* and turns it 180 degrees in the direction of arrow 100 (FIG. 5B).

The connecting collapsible connectors cause the adjacent left and right substantially rigid spacers 14A, 16A, respectively, to cross over each other as shown in FIG. 5B, thereby allowing rung 12A to be positioned adjacent and parallel to rung 12B.

As shown in FIG. 5C, rungs 12A & 12B are then rotated 180 degrees about arrow 102 causing spacers 14B and 16B to cross over each other, thereby positioning rungs 12A & 12B adjacent to and parallel to rung 12C. This process is repeated with each successive rung 12C-12G, until the entire ladder 10 is collapsed into its collapsed position 13 of FIG. 5D.

Optional securing straps 22, 24 with securing structures 26 operably secured thereto, such as hook and loop material or the like, preferably extend from the ladder 10 as best shown in FIG. 1. These securing straps 22, 24 wrap around the collapsed ladder in its collapsed position thereby holding the ladder in its collapsed position for storage and the like.

The ladder may be easily set-up from its collapsed configuration 13 (FIG. 5D) by reversing the above steps. It can be appreciated that the substantially rigid spacers 14A-G and 16A-G prevent the ladder from becoming tangled during set-up or when collapsing the ladder 10.

Figure 4:
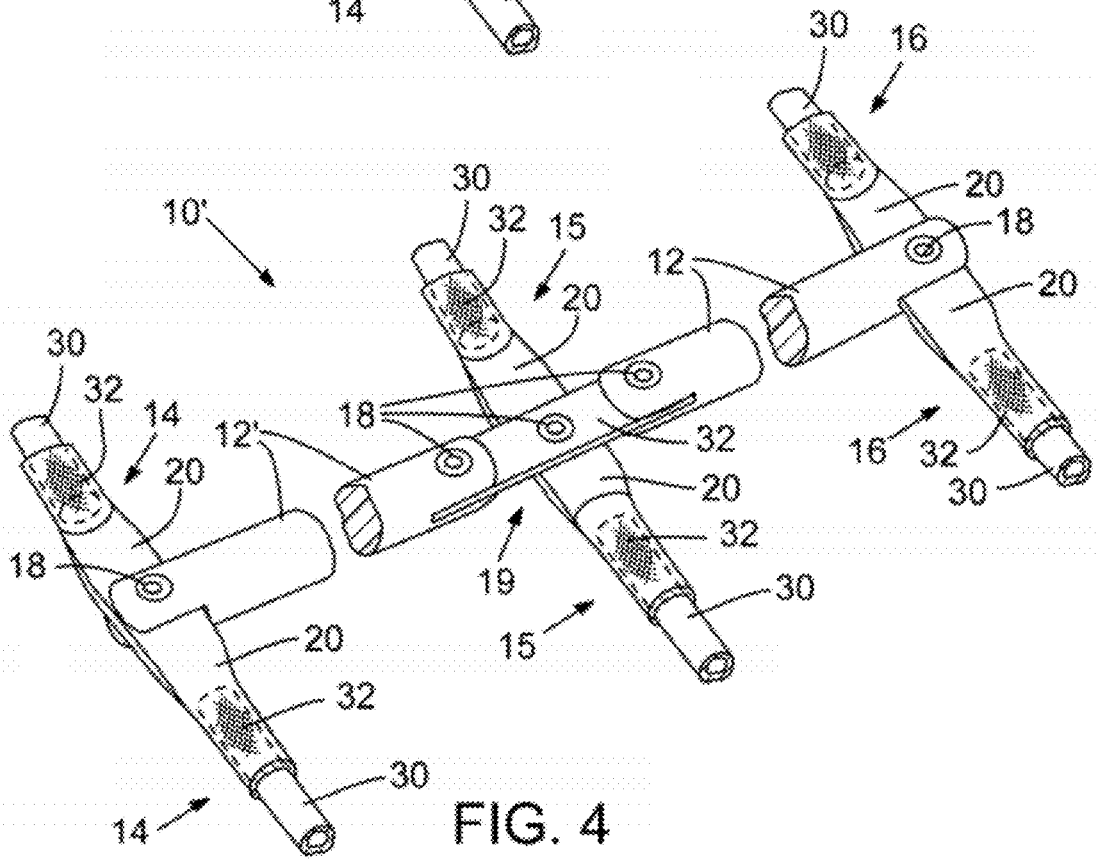
FIG. 4 is an enlarged, partial view of a section of the alternative collapsible athletic ladder of FIG. 2.

Referring to FIGS. 2, 4, and 6A & B, an alternative preferred collapsible athletic training ladder 10' is disclosed. This ladder features two lines of parrellely-aligned spaced apart rungs 12, 12' separated by a plurality of central spacers 15. The left and right sides of the ladder 10' are configured substantially similar to the respective left and right sides of ladder 10 (FIGS. 1, 3, and 5A-D)

As best shown in FIG. 4, a slightly modified collapsible connector 19' is provided to connect the left and right rungs 12, 12' to the central spacers 15. As with the first ladder embodiment 10, the substantially rigid members 30 forming the central spacers 15 are preferably received within pockets 32 of an elongate flexible structure, such as woven nylon or the like. Preferably, each such rigid member 30 is rigidly secured within a pocket 32 by adhesive, sewing the pocket shut, or the like. A plurality of rigid members 30 are aligned within their respective pockets 32, but spaced apart from each other to define a flexible mounting portion 20 therebetween.

The distal ends of the rungs 12, 12' are operably secured to an elongate flexible member 32. Preferably, the rungs 12, 12' are rigidly secured to the flexible member 32 with rivets 18 as shown. The flexible mounting portion 20 is then secured to the flexible member 32 with a third rivet 18 as shown.

Referring to FIGS. 6A & 6B, it can be appreciated that the collapsible connectors 19, 19' connecting the rungs 12, 12' with the spacers 14, 15, 16 allow the ladder 10' to easily transition from its extended position shown in FIG. 2, to a fully collapsed position similar to that shown in FIG. 5D.

Referring to FIG. 6A, with the ladder in its extended position a user grasps the right side of the ladder and folds it in the direction of arrow 104 along the central spacers 15 so that the right side rests substantially on the left side as shown in FIG. 6B. In this configuration, the ladder 10' collapses using substantially steps previously set forth for ladder 10 shown in FIGS. 5A-D.

Optional securing straps 22, 24 with securing structures 26 operably secured thereto, such as hook and loop material or the like, preferably extend from the ladder 10' as best shown in FIG. 2. These securing straps 22, 24 wrap around the collapsed ladder in its collapsed position thereby holding the ladder in its collapsed position for storage and the like.

The ladder 10' may be easily set-up from its collapsed configuration by reversing the above steps. It can be appreciated that the substantially rigid spacers 14, 15, and 16 prevent the ladder 10' from becoming tangled during set-up or when collapsing the ladder 10'.

If desired, the spacers 14, 15, 16 can include elongate, hollow, tubes with an elastic shock chord extending therethrough to facilitate maintaining the ladder in its operational position during use.

Having described and illustrated the principles of our invention with reference to a preferred embodiment thereof, it will be apparent that the invention can be modified in arrangement and detail without departing from such principles. For example, although the collapsible connectors 19, 19' have been described in terms of having a flexible connection between the rungs and spacers, similar benefits could also be achieved by pivotally securing the rungs to the spacers. Accordingly, in view of the many possible embodiments to which the principles may be put, it should be recognized that the detailed embodiments are illustrative only and should not be taken as limiting the scope of our invention. Accordingly, we claim as our invention all such modifications as may come within the scope and spirit of the following claims and equivalents thereto.

The invention claimed is:

1. A collapsible athletic training ladder having an extended position and a collapsed position, said ladder comprising:

a plurality of substantially rigid rungs, each rung of said plurality of rungs spaced apart from each other; and substantially parallely aligned with each other when said ladder is in its extended position;

a plurality of substantially rigid elongate spacers extending between said plurality of substantially rigid rungs; and a collapsible connector joining at least one rung of said plurality of rungs to at least one substantially rigid elongate spacer thereby permitting transition of the ladder between said extended position and said collapsed position.

2. The collapsible athletic training ladder of claim 1, wherein said collapsible connector comprises a flexible strip of material rigidly secured to said at least one rung and at least one substantially rigid elongate spacer of the plurality of substantially rigid elongate spacers.

3. The collapsible athletic training ladder of claim 1, wherein said collapsible connector comprises a flexible strip of material pivotally secured to one of said at least one rung and at least one substantially rigid elongate spacer of the plurality of substantially rigid elongate spacers.

4. The collapsible athletic training ladder of claim 1, wherein said at least one substantially rigid elongate spacer of the plurality of substantially rigid elongate spacers comprises:

an elongate flexible member having a sleeve therein;

an elongate substantially rigid member operably received within said sleeve.

5. The collapsible athletic training ladder of claim 4, wherein said elongate substantially rigid member is formed from a light weight and durable polymer.

6. The collapsible athletic training ladder of claim 4, further including: said elongate flexible member having a flexible portion spaced apart from said elongate substantially rigid member;

said flexible portion defines a rung mounting portion; and said at least one rung is operably secured to said rung mounting portion.

7. The collapsible athletic training ladder of claim 4, further including a second collapsible connector, said collapsible connector and said second collapsible connector secured at opposite ends of said at least one said rung.

8. The collapsible athletic training ladder of claim 7, further including:

a second at least one substantially rigid elongate spacer;

at least one substantially rigid elongate spacer of the plurality of substantially rigid elongate spacers is operably secured to said collapsible connector; and said second at least one substantially rigid elongate spacer is operably secured to said second collapsible connector.

9. The collapsible athletic training ladder of claim 1, further including a second plurality of spaced-apart rungs, each rung of said second plurality of rungs parallely aligned with each other and spaced apart from each other.

10. The collapsible athletic training ladder of claim 9, wherein said plurality of spaced-apart rungs and said second plurality of spaced-apart rungs are parallely aligned with each other and positioned adjacent to each other along an elongate central set of substantially rigid spacers.

11. The collapsible athletic training ladder of claim 10, wherein said elongate central set of substantially rigid spacers are operably joined to said plurality of spaced-apart rungs and said second plurality of spaced-apart rungs with a plurality of collapsible connectors.

12. The collapsible athletic training ladder of claim 1, wherein said plurality of rungs are colored differently from said plurality of spacers.

13. The collapsible athletic training ladder of claim 11, wherein:

each rung of said plurality of rungs is substantially cylindrical defining a first cross-sectional, outer diameter;

each spacer of said plurality of spacers has a substantially cylindrical shaft defining a second cross-sectional outer diameter; and, said first cross-sectional outer diameter is larger than said second cross sectional outer diameter.

14. The collapsible athletic training ladder of claim 1, further including a securing strap operably secured to said ladder for securing said ladder in said collapsed position.

15. The collapsible athletic training ladder of claim 1, wherein said plurality of spaced-apart rungs are formed of a light weight and durable polymer.

16. A collapsible athletic training ladder having an extended position and a collapsed position, said ladder comprising:

a plurality of substantially rigid rungs including at least a first rung and a second rung, both having a right end and a left end, wherein each end is joined to a collapsible connector;

a first substantially rigid elongate spacer extending between and operatively connecting the collapsible connector located on the left end of the first rung with the collapsible connector located on the left end of the second rung;

a second substantially rigid elongate spacer extending between and operatively connecting the collapsible connector located on the right end of the first rung with the collapsible connector located on the right end of the second rung;

wherein at the extended position, the first and the second rungs are spaced apart and parallely aligned with each other, and the first and the second spacers are spaced apart and perpendicularly aligned with the first and second rungs; and wherein at the collapsed position, the first and second rungs are parallely aligned and positioned adjacent with each other and the first and second spacers.

17. The collapsible training ladder of claim 16, wherein upon the ladder being in the extended position, the first rung is configured to be twisted about a horizontal plane parallel with the second rung, wherein upon twisting the first rung about the horizontal plane, the left end of the first rung is vertically aligned with the right end of the second rung and permits the ladder to be placed in the collapsed position.

18. The collapsible athletic training ladder of claim 17, wherein the first collapsible connector comprises a flexible strip of material rigidly secured to the first rung and the first spacer.

19. The collapsible athletic training ladder of claim 17, wherein the first collapsible connector comprises a flexible strip of material pivotally secured to the first rung and the first spacer.

20. The collapsible athletic training ladder of claim 16, wherein said first rigid elongate spacer comprises:

an elongate flexible member having a sleeve therein;

an elongate substantially rigid member operably received within said sleeve.

* * * * *